US005358587A

United States Patent [19]

Voigt, Jr.

[11] Patent Number: 5,358,587

[45] Date of Patent: Oct. 25, 1994

[54] SIMPLIFIED EMULSION COATING OF CRYSTALLINE EXPLOSIVES IN A TNT MELT

[76] Inventor: H. William Voigt, Jr., 63 Brooklyn Rd., Stanhope, N.J. 07874

[21] Appl. No.: 962,090

[22] Filed: Oct. 16, 1992

Related U.S. Application Data

[63] Continuation of Ser. No. 724,075, Jul. 1, 1991, abandoned.

[51] Int. Cl.[5] ..... C06B 45/06

[52] U.S. Cl. ..... 149/18; 149/11; 149/92; 149/105

[58] Field of Search ..... 149/11, 18, 92, 105

[56] References Cited

U.S. PATENT DOCUMENTS

| | | | |
|---|---|---|---|
| 3,740,278 | 6/1973 | Sakreis et al. | 149/11 |
| 3,759,765 | 9/1973 | Young | 149/11 |
| 4,090,894 | 5/1978 | Reed et al. | 149/11 |
| 4,092,187 | 5/1978 | Hildebrant et al. | 149/11 |
| 4,284,442 | 8/1981 | Voigt | 179/18 |
| 4,357,185 | 11/1982 | Ringbloom | 149/11 |
| 4,425,170 | 1/1984 | Jones | 149/11 |
| 4,445,948 | 5/1984 | Stanton et al. | 149/18 |
| 4,699,741 | 10/1987 | Back et al. | 149/11 |

*Primary Examiner*—Edward A. Miller

[57] ABSTRACT

A method of making cast 60/40 RDX/TNT explosives in which RDX is admixed in TNT to form a safer and more effective explosive mixture. The method includes the steps of admixing a latex emulsion with RDX in an amount sufficient to at least partially coat the RDX with the latex, and removing excess moisture from the admixture. The coated explosive is added to the TNT to form a casting mixture and thereafter solidified to form the 60/40 explosive. In a preferred embodiment, the latex is selected from polyethlyene latexes, polyurethane latexes and acrylic latexes.

1 Claim, No Drawings

SIMPLIFIED EMULSION COATING OF CRYSTALLINE EXPLOSIVES IN A TNT MELT

The invention described herein may be made, used, or licensed by or for the Government for Governmental purposes without the payment to me of any royalties thereon or therefor.

This application is a continuation of application Ser. No. 07/724,075, filed Jul. 3, 1991, and now abandoned.

FIELD OF THE INVENTION

The present invention relates to casting explosives and more particularly to a method of coating a crystalline explosive which is mixed with TNT.

BACKGROUND OF THE INVENTION

The present method of making mixtures of crystalline explosives such as RDX and HMX in TNT utilizes a water damp form of the crystalline explosive in order to reduce the danger in handling. Totally dry RDX is not suitable for general handling.

The present method involves adding water damp RDX to molten TNT, and then the moisture is removed from the RDX filled TNT melt. Typically, the ratio of RDX to TNT is 60/40.

In the standard procedure, wax of about 1 percent is added to the molten mix. The wax, insoluble in TNT, migrates and partially coats the suspended RDX crystals as the TNT matrix is solidified. However, at least half of the wax floats to the top of the melt, where it solidifies separately. An inexpensive petroleum base wax is commonly stirred into the already formed melted TNT. The RDX has been added with sufficient water, about 20% by weight, to prevent potential explosive conditions. RDX and other crystalline explosives may present some hazard due to electrostatic charges which they create in the totally dry state. For that reason, the RDX is added in a damp condition where it has been found to be safe.

One difficulty that has been found recently is the tendency of premature explosion when shells are loaded with RDX/TNT mixtures of this type, either with or without wax. This has become such a major problem that consideration is being given to using TNT alone, rather than using the mixture, even though RDX/TNT mixes have higher output as explosives.

In order to preserve the higher output and related advantages, it is desirable to find a method of formulating RDX/TNT mixtures, and other similar explosive mixtures, which can be accomplished without drying the crystalline explosive. It is an object of this invention to provide such a process, where crystalline explosives such as RDX can be mixed with TNT to obtain higher output.

Another object of this invention is to provide a method in which RDX can be coated to preserve a safe condition for mixing and transportation without drying the RDX or without using a separate process to accomplish this object.

Yet another object of this invention is to provide a process additive and method step which does not change the present conventional process for making such explosive mixtures.

Still another object of this invention is to provide a method which uses a safe, balanced additive to protect the crystalline explosive as it is added to molten explosives such as TNT, and preserve the safe condition of the melt-cast explosive fill loaded in projectiles and rockets during shipping and during firing or launching.

Other objects will appear hereinafter.

SUMMARY OF THE INVENTION

It has now been discovered that the above and other objects of the present invention may be accomplished in the following manner. Specifically, a method for mixing crystalline explosives such as RDX in molten explosives such as TNT has been discovered.

The method comprises the steps of coating the crystalline explosive with a latex emulsion either prior to or during the mixing with the molten explosive, whereby the crystalline component is uniformly coated. Water is driven off at elevated temperature and the mixture is then solidified.

The method results in a superior composition which is demonstrably better in several important properties of explosives. The method is simple and can be used in present production processes without major modification or the use of additional equipment. The method is safe, as it does not adversely affect the molten explosive.

DETAILED DESCRIPTION OF THE PREFERRED EMBODIMENT

For a more complete understanding of the present invention, the following description is presented. Specifically, the present invention relates to the improvement in formulating crystalline explosives suspended in meltable explosives to provide a dry and solid mixture which can later be added by melt-casting to projectiles.

One common mixture is known as the RDX/TNT 60/40 mixture. This mixture is used in a wide variety of projectiles and has met with great acceptance because of the relatively high output of the RDX and the simplicity of melt-casting of the TNT.

RDX is a trade or industry designation for cyclo trimethylene tri-nitramine, which can be expressed chemically as hexahydro-1,3,5-trinitro-1,3,5-triazine. A related crystalline explosive is HMX, which is the industry designation for cyclo tetramethylene tetranitramine. TNT, of course, is the industry designation for trinitrotoluene.

TNT is an explosive which is sensitive to alkaline conditions and to heavy metal presence. Prior art attempts to formulate TNT and explosives such as RDX have met with failure because various emulsions which have fatty acids or basic materials such as ammonia or morpholine actually react with the TNT and cause unstable or sensitive forms. Proposals to form such an emulsion and break it by lowering the pH using $BaCl_2$ requires that the metal salt be removed from the effluent water. All this involves a separate process which is more expensive and offers more opportunity for problems and dangerous conditions to exist.

As stated above, the method of this invention comprises the steps of coating the crystalline explosive with a latex emulsion either prior to or during the mixing with the molten explosive, whereby the crystalline component is uniformly coated. Water is driven off at elevated temperature and the mixture is then solidified. The preferred method comprises the steps of 1. melting TNT granules at about 80° C. or somewhat higher;
2. stir-in a water emulsion into the water-damp RDX in an amount based on total waxy solids to give the desired ratio, usually 60/40 RDX/TNT, plus 1% wax;
3. heat to about 100° C. to drive off water; and 4. cool and cast for later use.

Typically, step 4 above is carried out in conventional processes by casting the molten 60/40 mixture by pouring it onto a moving belt where slabs are formed, dried and shipped to another location for remelting and loading into shells.

The emulsion, described below, forms a latex like coating around the RDX or other crystalline explosive and provides superior and unexpected protection and improvements in properties. As will be seen, the improvements are more than merely mechanical and in fact permit the use of the 60/40 mixture where it would otherwise be discarded because of undesired side effects.

The key to the method of this invention is the formation of an appropriate water emulsion with the RDX or other crystalline explosive either prior to or during the melt mixing with the TNT. The preferred embodiment comprises the use of a small quantity of a polymer emulsion to water damp crystalline explosives such as RDX and HMX in order to form the latex like coating on the crystals. It is not necessary, to break the emulsion. As water is partially removed from the water emulsion damp slurry of RDX, the small particles of polymer spheres of the latex coalesce to form a film coating around the individual RDX crystals.

One preferred emulsion is a polyethylene emulsion, with particles of less than 0.1 microns emulsified by a sodium salt of a sulfonated hydrocarbon. The viscosity is about 17 cps and the melting point of a film cast from the emulsion is 124° C. The emulsion pH is 5.0. Emulsions such as this are available commercially.

One preferred emulsion having these properties is know by the trade name Poly-Em 20®, manufactured and sold by Rohm and Haas Corporation. This is a preferred material but it has been found that other latex emulsions such as polyvinyl acetate, polybutadiene, butyl elastomer, and acrylic latex emulsions have been found to be effective as well. An acrylic latex which has been found to be effective is Rohm and Haas Rhoplex B15®.

The Poly Em 20®is added to a water damp crystalline explosive such as RDX and blended at about 0.5% dry basis polyethylene. At this point, two optional methods can be used. One option is to stir the water damp crystalline explosive with the latex emulsion directly into molten TNT or the like and remove water at approximately 100° C. The molten mixture is poured at about 90° C. onto a cool surface or belt to solidify. This process is known as slabbing out the explosive. The other option is to precoat the RDX by heating the water damp mixture of crystalline explosive and latex emulsion in a steam oven to 100° C., to partially remove water in an amount sufficient to film-coat each crystal. The still damp mixture is then added to the molten explosive and the rest of the process is followed as above. Both options have been found to be successful and obviously the former option is easier to accomplish and involves one less step.

EXAMPLES

The resulting latex coated crystalline explosive in the molten explosive has been found to be far superior to identical uncoated mixtures. To demonstrate this surprising and superior results, the following experiments were performed.

EXAMPLE ONE

A conventional 60/40 mixture of RDX/TNT (Mix A) was prepared, as was a 60/40 mixture of RDX/TNT (Mix B) with 1% petroleum wax added directly to the melt. The preferred embodiment was also prepared, using a ratio of 60 RDX and 40 TNT as in the others, along with Poly-Em 20® water latex in the amount to yield 0.5% polyethlyene on a dry basis to the RDX. In the first batch, (Mix C-1) the RDX and latex were mixed directly into the TNT and the entire mixture was heated at 90° C. to reduce water content. In the second batch, (Mix C-2) the mixture of RDX explosive and polyethlyene latex emulsion was heated in a steam oven to 100° C., to partially remove water. The still damp mixture was then added to the molten explosive The product in each mixture was then solidified or "slabbed out" in the conventional manner.

In identical tests with each of the above prepared mixtures, all of which are classified as 60/40 RDX/TNT explosives, surprising and superior results were achieved with the mixtures of this invention. Specifically, Mix A, which is a straight blend had a high incident of premature explosions. The wax mix, Mix 2B showed no improvement. Some of the wax floated to the surface of the melt. A uniform mixture is not assured and the RDX crystals are not coated by the wax.

Presented below in the Table are the results of high pressure closed bomb burning rate tests on solid cylinders of cast explosives, clearly demonstrating the surprising improvement of the present invention. Of course, note is taken that the 60/40 mixtures all have superior explosive power over TNT alone.

TABLE

| TEXT NO. | EXPLOSIVE | CLOSED BOMB BURNING RATE |
|---|---|---|
| 1 | TNT | 11 m-seconds |
| 2 | Mix A | 2 m-seconds |
| 3 | Mix B | 2 m-seconds |
| 4 | Mix C-1 | 15 m-seconds |
| 5 | Mix C-2 | 15 m-seconds |

As can be seen from the data above, the predicted incidence of premature explosion is greatly reduced, base on the long burning rate obtained. At the same time, the high energy of the RDX/TNT mix is retained. The safety of the soldiers during gun firing is thereby enhanced.

In some instances, it is desirable to formulate a safety coated crystalline explosive which will be used either with or without a molten explosive such as TNT, For example, pressed explosives often use RDX, or would desire to use RDX, without TNT. Under these circumstances, the latex coated RDX of this invention can be modified by breaking the emulsion to form a polymeric film coating on the RDX crystal to produce free flowing coated crystals of RDX/latex explosive. This is demonstrated in the following example.

EXAMPLE TWO

To prepare 50 grams of a safe, dry crystalline RDX with a pre-prepared 1.67% polyethylene coating on each crystal, the following process is used. A solution of 0.025 grams of polyvinyl pyrrolidone, K90 molecular weight grade, product of GAR Corporation, in 20 ml of 95% ethanol, is combined with 50 grams of RDX, Class 1 (150 micron average) to make a slightly damp sludge.

Based on a total solids content of 40.8%, 2.03 grams of Poly Em 20 emulsion (0.833) grams solids) is diluted with 4 ml of water, then mixed with 20 ml of ethanol. The diluted Poly-Em 20 emulsion is stirred into the alcohol damp RDX. The resulting slurry is heated in a stainless steel beaker in a steam bath at 60° C. for 30 minutes. The resulting clear filtrate is removed by filtration and the coated crystalline filter cake is dried to a free-flowing product. The coated RDX was heat stable (no gassing in the 120° C. vacuum stability test).

To form 20.2 grams of the 60/40 RDX/TNT plus 1% polyethylene of this invention, 12.2 grams of this dry coated RDX is stirred into 8 grams of molten TNT and then solidified.

Coated RDX according to the above procedure, using coatings of 1.67% to 9% polyethylene, bay also be directly press-consolidated into projectiles or cylinders (without TNT) as plastic bonded explosives. The dry, coated RDX, tested in a 2 Kg.. drop-weight impact apparatus, had a drop height of 20 inches for 90% no explosions.

While particular embodiments of the present invention have been illustrated and described herein, it is not intended to limit the invention. Changes and modifications may be made herein within the scope of the following claims.

I claim:

1. In an explosive composition comprising trinitrotoluene (TNT) and cyclotrimethylenetrinitramine (RDX) or cyclotetramethylenetetranitramine (HMX) crystals, the improvement wherein:

a polyethylene film coating substantially all of the HMX or RDX crystals, the polyethylene coating having been made from a polyethylene latex, the polyethylene particles of said latex having a particle size of about 0.1 microns and a melting point of about 124 degrees Centigrade.

* * * * *